US006876302B1

(12) United States Patent
Steeves

(10) Patent No.: US 6,876,302 B1
(45) Date of Patent: Apr. 5, 2005

(54) NON-LETHAL PERSONAL DETERRENT DEVICE

(75) Inventor: Eric C. Steeves, Newbury, MA (US)

(73) Assignee: Verizon Corporate Services Group Inc., New York, NY (US)

( * ) Notice: Subject to any disclaimer, the term of this patent is extended or adjusted under 35 U.S.C. 154(b) by 50 days.

(21) Appl. No.: 10/341,025

(22) Filed: Jan. 13, 2003

(51) Int. Cl.[7] ..... G08B 13/14
(52) U.S. Cl. ..... 340/572.1; 340/825.19
(58) Field of Search ..... 340/572.1, 574, 340/521, 541; 89/1.11, 1.08; 222/1, 153.11, 78

(56) References Cited

U.S. PATENT DOCUMENTS 3,694,579 A * 9/1972 McMurray ..... 379/49
4,157,540 A * 6/1979 Oros ..... 340/539.11
5,032,824 A * 7/1991 Corbin ..... 340/574
5,476,192 A * 12/1995 Julinot ..... 222/78
5,629,679 A * 5/1997 Cranford et al. ..... 340/574
5,685,636 A * 11/1997 German ..... 362/259
5,712,679 A * 1/1998 Coles ..... 348/158
5,847,652 A * 12/1998 Yamamoto ..... 340/574
5,926,103 A * 7/1999 Petite ..... 340/825.19
6,052,051 A * 4/2000 Whalen ..... 340/425.5
6,237,461 B1 * 5/2001 Poole ..... 89/1.11
6,278,884 B1 * 8/2001 Kim ..... 455/556.1
6,439,432 B1 * 8/2002 Park ..... 222/113
6,646,542 B1 * 11/2003 Mardirossian ..... 340/7.29
6,681,120 B1 * 1/2004 Kim ..... 455/556.1

* cited by examiner

*Primary Examiner*—Daniel Wu
*Assistant Examiner*—Son Tang
(74) *Attorney, Agent, or Firm*—Leonard C. Suchtya, Esq.; Joe Wall, Esq.

(57) ABSTRACT

A non-lethal personal deterrent device and system. In the event of an attack by an assailant upon a victim, a device held in the hand of the victim takes a digital video and/or still image of the face of the assailant, flashes a strobe light upon the assailant, audio blasts the assailant with a warning message, obtains location information of the scene of the attack via a global positioning system (GPS), picks up audio interplay between the assailant and the victim, and transmits audio, video, and position information along with victim identification information to a receiver/processor center. The center relays the information to an operator for verification purposes which, in turn, immediately relays the information to a slam cam receptive police department thereby providing the police department with the advantage of having this information prior to responding to this emergency. Moreover, the information is valid evidence to be used by the police in apprehending the assailant, and by the district attorney at trial to obtain a conviction. Growing usage of the device shall widen its reputation as being a device that provides instantaneous and unstoppable transmission to responsive police of irrefutable evidence of identity of an assailant committing a crime. This reputation shall discourage potential assailants from attacking persons carrying a highly-visible slam cam in favor of others not as adequately protected.

21 Claims, 6 Drawing Sheets

NON-LETHAL PERSONAL DETERRENT DEVICE

BACKGROUND OF THE INVENTION

1. Field of the Invention

The present invention relates to personal security and, more particularly, to a non-lethal, hand-held device and/or system which obtains and transmits data including location and assailant identification data to police for both immediate response and longer-term pursuit of the assailant if not immediately apprehended.

2. Description of Prior Art

Far too many people have experienced, or have personal knowledge about, an attack or mugging during daylight or nighttime. Crimes of this nature in cities both large and small throughout the nation may seem on the increase. Obviously, the likelihood of such an unfortunate experience increases if one frequents dangerous neighborhoods. However, certain ordinary business activity, such as, for example, a landlord attempting to collect his/her rent, may require traveling through dangerous neighborhoods. Prior art deterrent devices include lethal or dangerous weapons such as handguns, knives, clubs, mace, etc. Unfortunately, these weapons can be wrestled-away by an assailant and used against the victim! Also, dangerous weapons such as pistols which are normally stored at a user's home when not being carried, if not properly controlled, can be taken by unauthorized individuals like children who can use them to accidentally injure or kill others.

Non-lethal prior art devices may therefore be more desirable for ordinary citizens to possess, at least from an overall safety viewpoint. Such devices include whistles, sirens, or other forms of alarms which can be limited in their usefulness under certain adverse conditions, for example, where the whistle cannot be heard above background noise. Some have resorted to being accompanied by attack dogs, e.g. German shepherd police-type dogs, but this approach then requires maintenance of that dog on a 24-hour, 7-day per week basis, which is not feasible for everyone. What is needed is an effective and non-lethal protection technique for use by ordinary citizens which can deter an attacker and simultaneously provide critical information to the local police when confronted. The present invention utilizes high technology capabilities to satisfy this need in a novel manner.

SUMMARY OF THE INVENTION

Embodiments of the present invention include systems, methods, and apparatus for enabling a potential victim of a potential assailant to employ non-lethal, personal, deterrence techniques to deter or discourage an attack or challenge by the assailant. In a particular embodiment, a non-lethal, personal, deterrent system provides deterrent protection for a system user against a potential assailant. The system includes a portable device (termed a "slam cam") including user ID, the device obtaining global positioning system (GPS) location-data specifying location of the device and assailant and obtaining an image such as, for example, a digital video image of the assailant. The digital video image may be obtained by a digital camera. A transmitter is integrated with the portable device for transmitting the user ID, location-data and digital video image to a dedicated receiving and processing center. The user ID, location-data and digital video image are relayed to a slam cam receptive police department and, if need be, from there to another police department nearest to the location, whereby department personnel can immediately respond. A slam cam receptive police department is one which has been predetermined by the slam cam user to have the capability to receive information which has its origins of transmission from the user's slam cam and which agrees to accept such information for police processing, response and/or relay to another police department closest to the location. The portable device is battery powered by rechargeable batteries and may be designed to resemble the shape of a highly visible videocam (the color could be "blaze orange" or the like). The handgrip of the device may include a compartment for the batteries. The system user operates the portable device by activating a switch such as depressing the button of a button switch.

In a further feature, a microphone may be affixed to the exterior of the portable device to convert sounds of voices of the user and/or the assailant along with any ambient or background sounds into electrical signals for transmission via the transmitter to the dedicated receiving and processing center.

The transmitter includes an antenna and a wireless modem for modulating and demodulating information corresponding to the user ID, the video image and the electrical signals, thereby preparing them for cellular-styled broadcast from the antenna to the dedicated receiving and processing center. The receiving and processing center immediately relays the electrical signals to a monitor which can determine if the transmission represents a genuine attack or a false alarm. If the attack is genuine, the identification information, location-data, digital video image and electrical signals are immediately relayed to the slam cam receptive police department to enable police department personnel to view the assailant and to listen to any vocal exchange between the assailant and the system user to facilitate an appropriate or tailored response. Subsequently, the monitor also electronically forwards a bill for broadcast time to the user's pre-arranged billing address, which can be fixed fee or a function of broadcast time duration.

In yet a further feature, a warning mechanism may be integrated with the device for flashing a bright strobe light on the assailant as a deterrent and to facilitate the obtaining of the video image. The warning mechanism may include an audio warning; device for communicating a loud audio message to the assailant to the effect that the facial image of the assailant is being recorded and transmitted to the police. The message may be in English or any desired foreign language, controllable by the system user, and may be selected on the basis of the predominant ethnicity of the neighborhood in which the system user happens to be. The portable device also includes a computer control module for controlling operation of, and cooperation amongst, the digital camera, the strobe light, the audio warning, the microphone, the wireless modem and the location-data obtaining device.

It is thus a general object of the present invention to provide an improved, non-lethal, personal deterrent technique.

It is another object of the present invention to provide an improved portable, personal security system including a device which both deters would-be assailants by its recognizable appearance and reputation, and simultaneously communicates assailant/victim location information along with assailant and victim identification information ultimately to police.

It is thus advantageous to utilize embodiments of the present invention when undertaking activities in, or traveling through, neighborhoods which are likely to increase probabilities of being confronted with a would-be assailant.

Other objects and advantages shall become apparent after reviewing the detailed description of the preferred embodiments in conjunction with the drawings in which:

Figure 1:
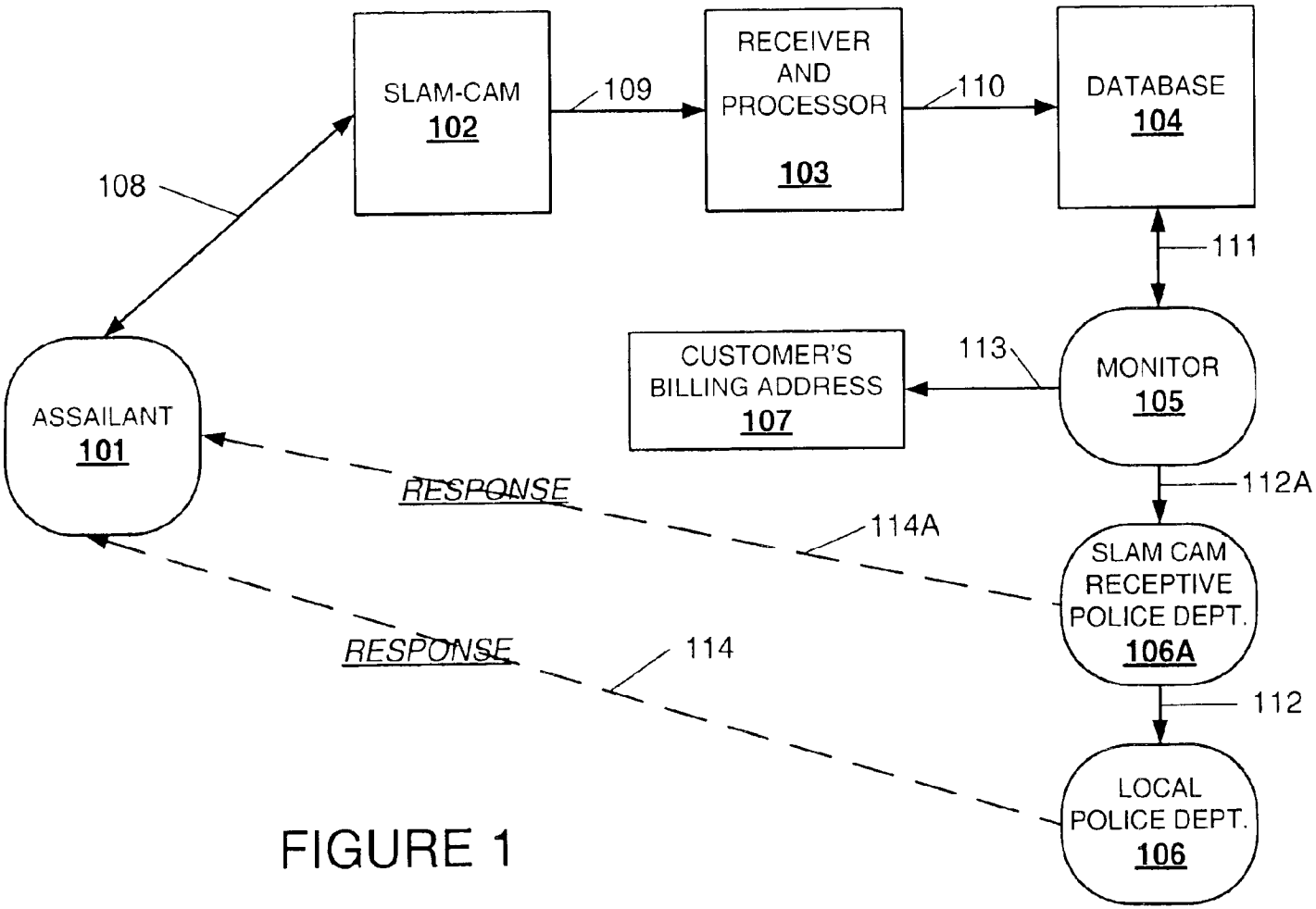
FIG. 1 includes an exemplary system block diagram of the present invention.
Figure 2:
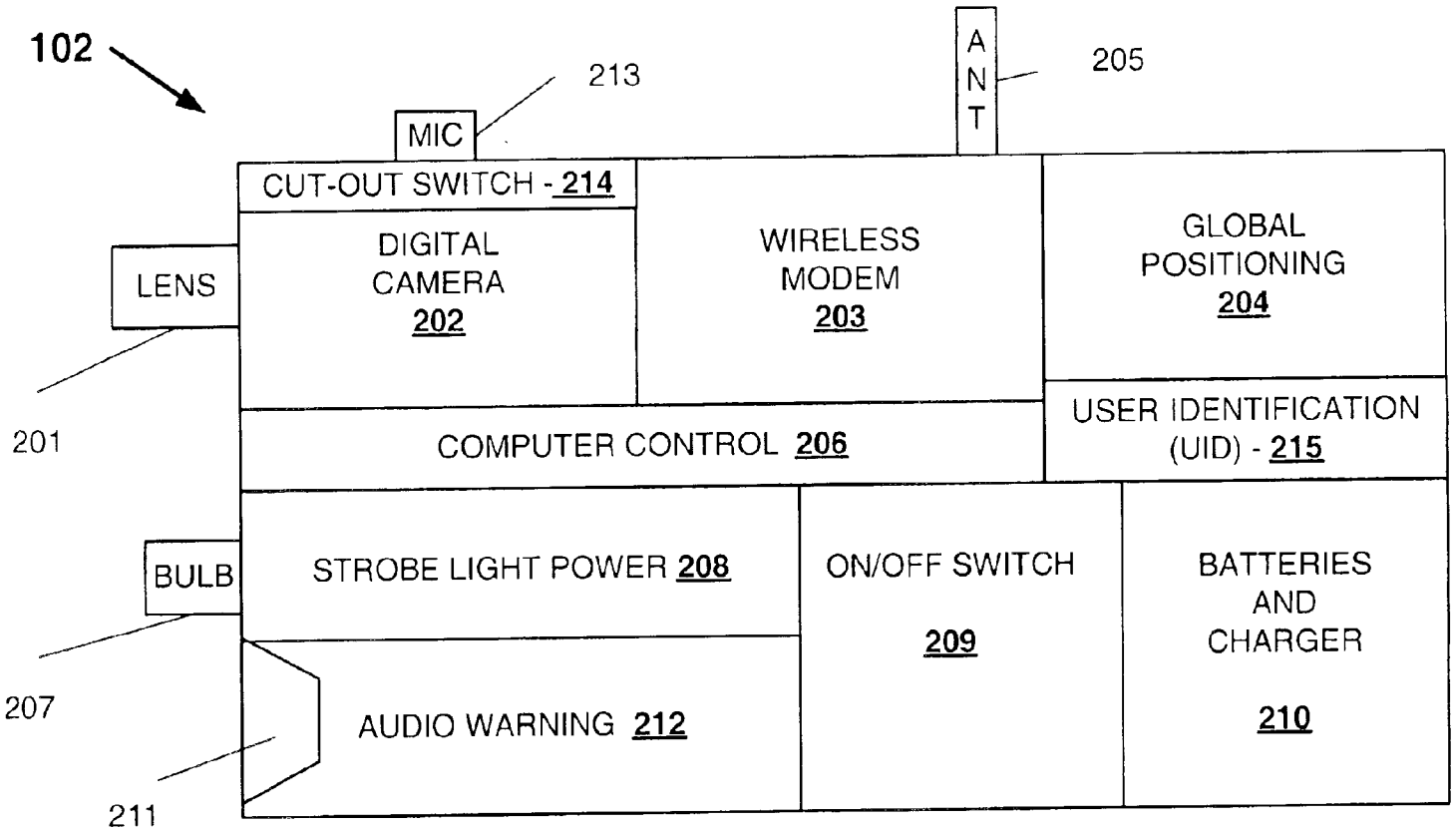
FIG. 2 is an exemplary functional block diagram of components which may be included in a portable, handheld device in accordance with principles of the present invention.

Subject matter presented for the first time in a particular figure shall be identified by a reference number within a range of numbers that are keyed to that particular figure; i.e., FIG. 1 includes reference numbers in the 100's range, FIG. 2 includes reference numbers in the 200's range, etc.

DETAILED DESCRIPTION OF THE PREFERRED EMBODIMENTS

FIG. 1—System Block Diagram

FIG. 1 is an exemplary system block diagram of the present invention and/or how the present invention may be used in a suitable communication and response system. In an overview system presentation, in the upper left hand side of the diagram, an assailant such as an "attacker" or "mugger" or other undesirable person 101 confronts a victim (not shown) holding a "slam cam" 102. The term "slam cam" is short-hand or marketing terminology intending to convey the idea of a camera that can withstand a heavy impact (a "slam") and can still transmit images and audio. A secondary connotation may be that this camera can put an assailant in the "slammer" (penitentiary). The victim or slam cam user trains and activates slam cam 102 upon attacker 101 via audio-visual information-gathering link 108.

The information generated by activation of slam cam 102 is instantaneously conveyed via telecommunication link 109 to a fixed-base receiver and processor 103. There may be a group of stations comprising receiver and processor 103 and transmission link 109 may connect with the closest or most logistically-advantageous station in the group relative to the locus of the attacker/victim. Receiver and processor 103 receives and instantaneously processes the transmitted information (which may comprise video, audio, and other information—to be discussed below) received from link 109, and instantaneously stores all or a portion of it in a database 104 via link 10.

Database 104 is monitored by human operators on a "24/7" basis (twenty-four hours and seven days per week basis) on monitor 105. There is a staff of such operators and they are assigned to monitor 105 on a rotating basis or on an as-needed basis so that monitoring coverage is without lapse. Monitor 105 is electronically wired and/or telecommunicatively connected (fax, email, telephone, etc.) via link 112A to a slam cam receptive police department 106A. Police department 106*a* may be in a precinct which includes the user's residence or the user's business address, for example. If the location of the attack is also within this precinct, then police department 106A provides direct response 114A as shown on an emergency basis. However, if the location of the attack is outside this precinct, then police department 106A contacts police department 106 which is closest to the location of the attack, via standard police-to-police communication infrastructure 112. Police department 106 provides response 114 as shown on an emergency basis. Responses 114A or 114 may take the form of radio-link dispatching one or more police department squad cars with sirens blaring (or in stealth mode if deemed desirable under the circumstances) in a manner familiar to most citizens.

Embodiments of the present invention are emergency tools to be used in emergency situations. However, business enterprises that provide products in accordance with the principles of the present invention may recoup their costs and seek a reasonable profit based on sale or license of the product to the user and based on time of usage. For example, monitor 105 may forward an electronic debit note (via email) to the user's billing address 107 which had been obtained at the time of sale or license of the device. The bill can be calculated based on a fixed fee or can be based on transmission or broadcast time duration. If embodiments of the present invention are marketed by a communications company, such as a telephone company, then slam cam charges could alternatively be included in the user's telephone bill.

Figure 2A:
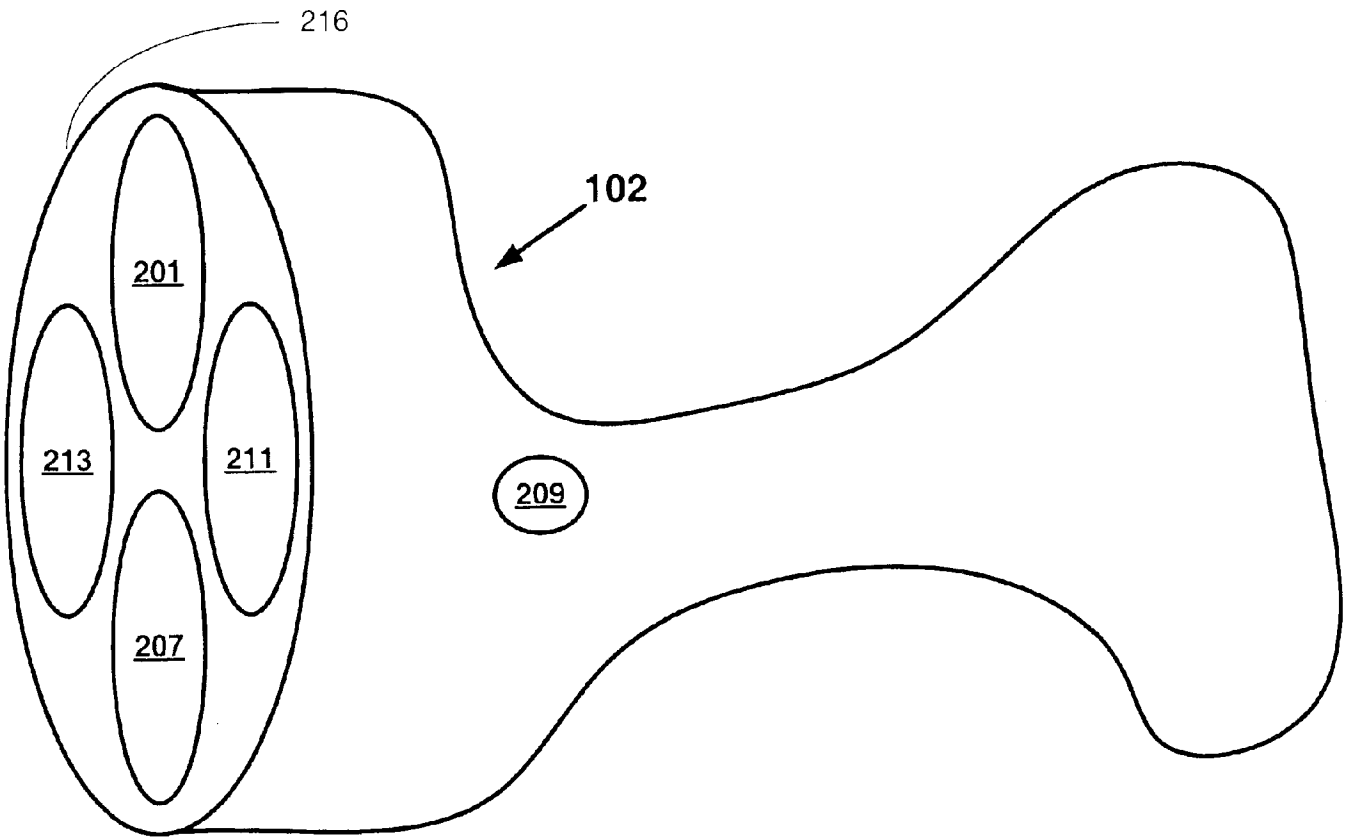
FIG. 2A is an example of an external view the assembled portable, handheld device of FIG. 2.

FIGS. 2 and 2A—Hand Operated Protector

FIG. 2 is an exemplary functional block diagram of components which may be included in a portable, handheld device in accordance with principles of the present invention. FIG. 2A is an example of an external view the assembled portable, handheld device of FIG. 2. First of all, it can be seen that the external appearance of the device of this example may resemble a flashlight or some other non-lethal object, and certainly does not resemble a handgun. It is advantageous for the outward appearance of the device to resemble or connote a handheld video camera which could thereby convey the thought to a would-be assailant that his/her picture shall be taken if an assault is attempted. It is important that the outward appearance of the device not be perceived as a physical threat by the assailant to try to reduce the probability of the assailant violently reacting to a perceived physical threat. In other words, if the device looked like a handgun, then the assailant might use his/her handgun if one was being carried by the assailant. (It is to be understood that outward appearance of the hand held device of the present invention may assume virtually any non-threatening shape compatible with being held in one or two hands, and a barrel or flashlight shape is depicted herein in FIG. 2A solely for purposes of clarity of presentation.)

Conveyance of the non-lethal functionality of the handheld device to an assailant can be facilitated by making it very visible. Accordingly, its casing can be finished in a very bright color such as a day-glo "blaze orange" used by hunters in the forest or with which traffic cones are painted, etc. Other colors can also be used. An important goal is for the device to become highly recognizable as a non-lethal, "smart" camera which is able to capture and transmit images of an assailant to a secure location even if the device is destroyed, thereby deterring an assault by its very presence (much as a uniformed policeman might deter a problem which might otherwise manifest).

Starting at the upper left of the diagram of FIG. 2, the components in slam cam 102 and supported by or included within the casing of the handheld device of FIG. 2A include: lens 201, digital camera 202, audio microphone 213, microphone cut-out switch 214, wireless modem 203, global positioning device 204, antenna 205, computer control 206, user identification module (UID) chip 215, strobe light bulb 207, strobe light power 208, on/off or thumb/button switch 209, batteries/charger 210, audio speaker 211, and audio warning component 212. Additional or fewer components could comprise slam cam 102 without departing from the scope or spirit of the present invention. Not all of these components are visible in FIG. 2A; for example, antenna 205 may be placed internal to the casing of the handheld device. The device is intended to be gripped by a hand of the user in a manner to permit easy operation of button switch 209 by the thumb or forefinger.

With further reference to FIG. 2, digital camera 202 may be constructed from a charge-coupled-device (CCD) and supporting electronic and storage circuitry as known in the art. Such a camera is commercially available from numerous manufacturers and may be a 35 millimeter camera. Other digital cameras such as those having other lens sizes may be used. Lens 201 is operatively coupled to and integrated with digital camera 202 to enable the taking of focussed digital pictures (video and/or still images) of a subject—in this case an assailant. In most embodiments, lens 201 will be of the auto-focusing variety, although fixed focal length and manually-focusing lenses can also be used. The digital output from digital camera 202 is applied to modem (modulator/demodulator) 203 which operates upon the digital output to prepare it for wireless transmission via antenna 205 to which the modem is operatively coupled. Wireless modem 203 is known in the art, available commercially, and operable in multiple communication formats such as cellular, Bluetooth™; and the like. Global positioning system (GPS) 204 has the capacity to identify its current location through orbiting satellites with which it communicates via antenna 205. GPS 204 is commercially available and will normally be in the form of an integrated circuit chip. GPS 204 may be similar to the types of systems currently deployed in handheld GPS receivers and/or selected automobiles.

At the lower left of FIG. 2, strobe light power module 208 energizes bulb 207 upon command. This illuminates the assailant in a powerful strobe beam while ensuring sufficient illumination to permit well-defined images to be captured by digital camera 202. Digital camera 202 can be synchronized with strobe bulb 207 so that pictures are taken when the attacker is illuminated. And, adjacent module 208 is audio warning module 212 which includes electronic means for repetitively blasting a loud audio message over speaker 211 with which it is operatively coupled. For example, this audio message may be provided by way of a digital electronic audio or sound card. The card may contain the same message (e.g. "STOP: YOUR PICTURE IS BEING BROADCAST TO THE POLICE") in various languages from which the preferred language(s) may be pre-selected by the user of slam cam 102. Alternatively, the message may be repetitively broadcast in multiple languages, e.g., first in English, then in Spanish, then in Russian, etc., with repetition of that sequence. Cut out switch 214 operates to disconnect microphone 213 during the audio message to protect the microphone during the audio blasts. The strobe light and audio modules are commercially available.

In FIG. 2A, lens 201 and strobe bulb 207 are shown in close mutual proximity, but they may alternatively be mounted on opposite sides of periphery 216 to add distance therebetween to reduce any optical artifacts. Likewise, audio speaker 211 and microphone 213 are shown in close mutual proximity, but they may also be alternatively mounted on opposite sides of periphery 216 to add distance therebetween to reduce any audio artifacts.

Operation of the various components and modules identified herein is controlled by computer control 206. Rechargeable, or disposable batteries 210 power all of the components and modules, and such power is applied when switch button 209 is operated by the slam cam user in response to an aggression by an assailant.

Figure 3:
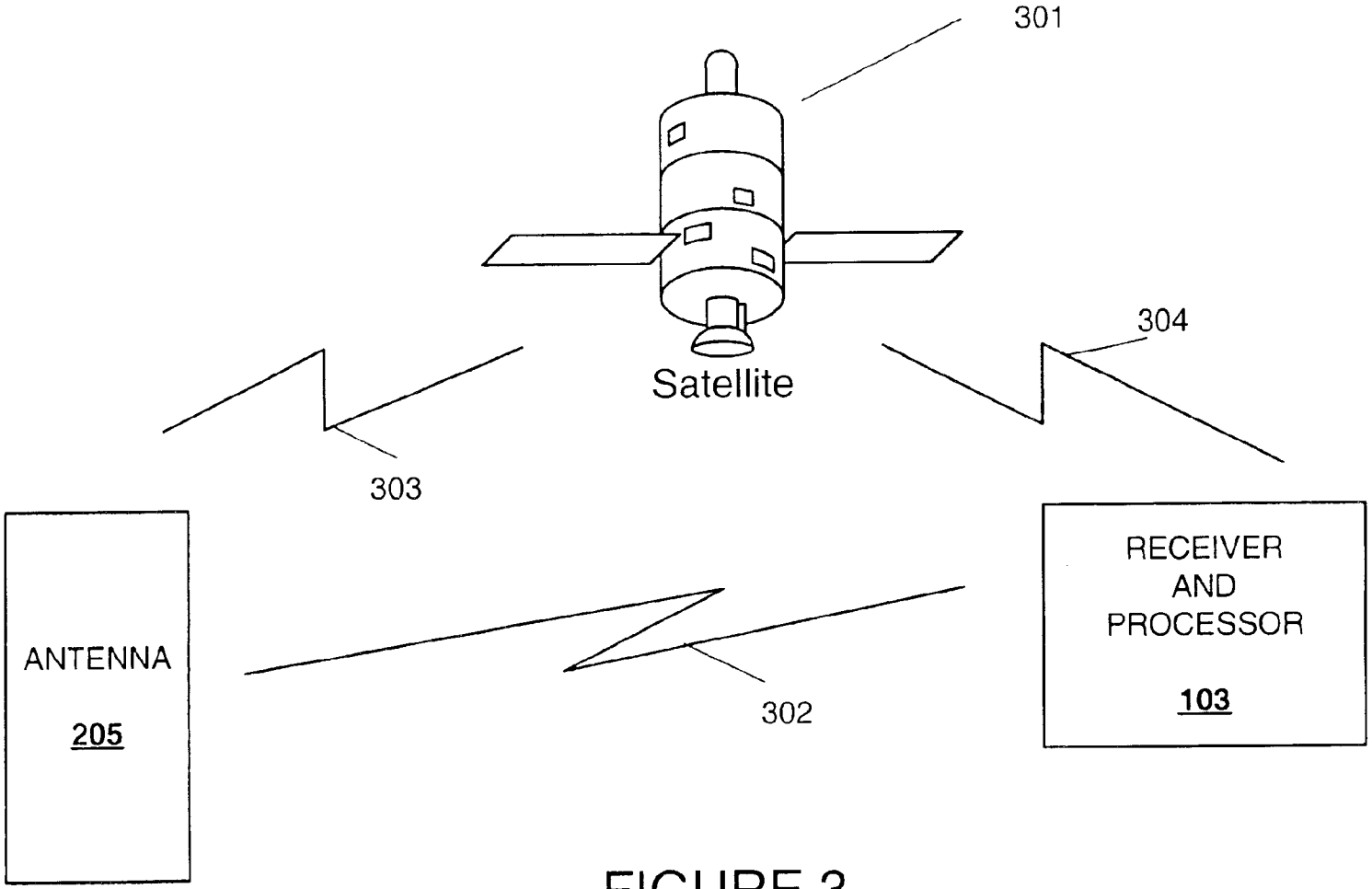
FIG. 3 is an exemplary block diagram depicting communication paths utilized by the device of FIG. 2 within the context of the system of FIG. 1.

FIG. 3—Transmission Modes

FIG. 3 is an exemplary block diagram depicting communication paths utilized by the device of FIG. 2 as employed in the system of FIG. 1. Antenna 205, orbiting telecommunications satellite 301, and receiver/processor 103 are shown. Signal 302 communicatively couples antenna 205 and receiver processor 103. Signal 303 communicatively couples antenna 205 and satellite 301. And signal 304 communicatively couples satellite 301 and receiver/processor 103.

Antenna 205 is shown broadcasting a cellular signal 302 directly to receiver and processor 103. This signal may include, as one of its components, the digitized video image of the assailant obtained by digital camera 202 and lens 201 as modulated by modem 203. In addition, this signal may include, as another of its components, an appropriately amplified and modulated (for example, amplitude modulation, frequency modulation, or pulse code modulation, etc.) audio signal, again using modem 203. The audio signal is obtained by microphone 213, amplified by a suitable amplifier (not shown), and modulated in modem 203. And, this signal may also include as yet another of its components the user identification (UID) signal, i.e., the information identifying the person to whom this particular slam cam has been issued or sold. This information, for example, name, address, social security number, next of kin, (and even special medical information such as blood type, diabetic condition, hemophiliac condition, allergic reactions, etc.) may be coded into UID chip 215 by the vendor and/or purchaser at time of purchase of the slam cam. This permits the police department to almost instantaneously have access to the victim's critical information including critical medical information should emergency medical intervention be needed if the assailant injured the victim and rendered him/her unconscious while being repelled by the slam cam. If special medical information is coded into the slam cam, care should be taken to ensure that it is used only by the person to whom that information applies.

Antenna 205 may further receive global positioning information from satellite 301 via signal 303 which is demodulated in modem 203 and utilized in GPS 204. This useful positioning mechanism operates in accordance with known principles governing global positioning systems that are commercially available, for example, systems similar to those installed in certain selected automobiles today. Antenna 205 then broadcasts this positioning information (street name, near intersection such and such, alleyway such and such, etc.) to receiver/processor 103 via signal 302 which forwards such positioning information to monitor 105. If the positioning information is determined by monitor 105 to be bona fide and not a false alarm, the information is immediately forwarded to slam cam receptive police department 106A and, if need be, from police department 106A to local police department 106. This predetermined location/position information enables the police to head in the proper direction, without floundering, and thus arrive on the scene as promptly as possible. In addition, capability may be included in the system of the present invention to take advantage of existing cellular networks to create a communication path 303/304 through satellite 301 by any of those signal(s) which would normally use direct path 302. This alternative path through the satellite could be invoked automatically as a back up transmission path, if the handheld device determined that there was a communication breakdown via direct path 302.

Figure 4:
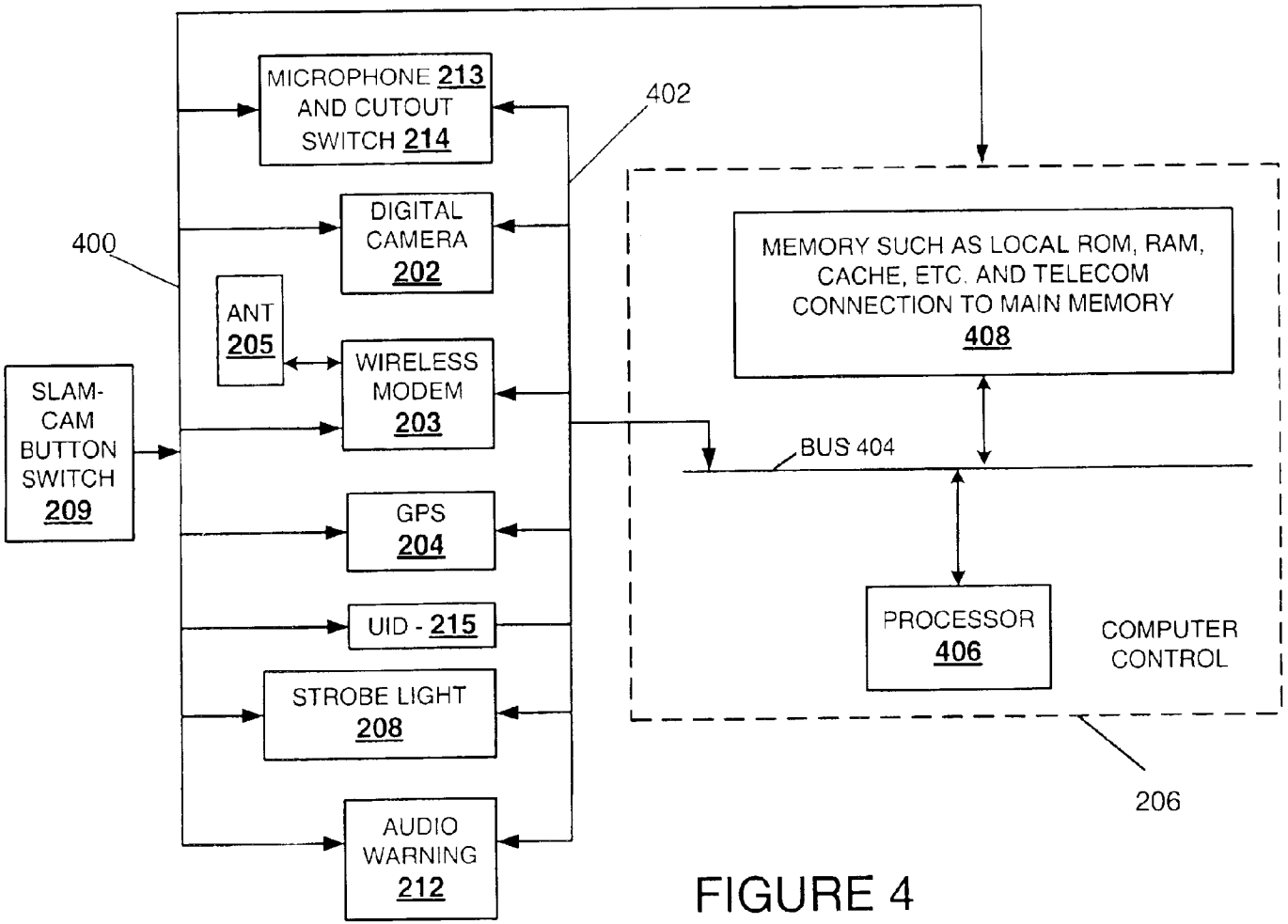
FIG. 4 is an exemplary block diagram depicting computerized control operation of the device of FIG. 2; and, FIG. 5 is an exemplary block diagram of processing and monitoring functions depicted in FIG. 1.

FIG. 4—Slam Cam Operation

FIG. 4 is an exemplary block diagram depicting operation of the device of FIG. 2 under computerized control. At the left of the diagram, slam cam button 209 is operatively coupled by way of bus or conductive connection 400 to a number of components, namely: computer control 206, microphone 213 and cut out switch 214, digital camera 202, wireless modem 203, global positioning system 204, user identifier 215, strobe light 208, and audio warning 212. The same group of modules are also operatively coupled by bus 402 and bus 404 to each other as may be necessary for proper functioning of the device. Computer control 206 comprises processor 406 and memory 408. Computer control 206 may be a microprocessor such as those made commercially available by companies such as Intel. Memory 408 may include local read only memory (ROM), random access memory (RAM), cache memory, etc. as well as a main memory data storage facility (not shown) with which it is connected by a telecommunications link. Processor 406 and memory 408 communicate with each other over bus 404 using protocols known in the art such as ethernet, IDE, SCSI, and the like.

In operation, the slam cam user/victim (not shown) presses button 209 while aiming lens 201 at the assailant (not shown). This activates a signal powered by batteries 210 over power and/or signal line 400 to the components specified above thereby activating certain of those components which had not previously been powered-on by more permanent connections to batteries 210. Microphone 213 is thereby enabled to detect any sounds in the immediate vicinity and sends signals representative of those sounds over bus 402 to wireless modem 203 which modulates those signals prior to broadcasting them over antenna 205. Digital camera 202 is likewise enabled to start taking digital pictures of the assailant and whatever background scene upon which its lens 201 is trained. Digital camera 202 sends digital signals over bus 402 to computer control 206 as may be necessary for processing and to wireless modem 203 which modulates those digital signals prior to broadcasting them over antenna 205. Wireless modem 203 is activated to enable it to modulate signals received over bus 402 from other components and to demodulate signals received by way of antenna 205.

Depending upon the type of global positioning system being employed, GPS 204 may previously have been energized or it may be energized by operation of button 209 to enable it to receive signals coming from satellite 301 (via antenna 205 through modem 203 which demodulates the signals prior to GPS 204 receiving them) representing global positioning information. GPS 204 then utilizes those signals and communicates with computer control 206 over bus 404 as may be necessary to provide any processing power required to calculate accurate position information. GPS 204 then sends a signal representing local position information over bus 402 to modem 203 which modulates that signal prior to broadcasting it over antenna 205 as signal 302 directly to receiver and processor 103. As previously described, monitor 105 receives and verifies such information and then forwards such position information to slam cam receptive police 106A.

UID chip 215 is energized by operation of button 209 and it provides user identification signals over bus 402 to modem 203 for broadcast via antenna 205 to receiver and processor 103 and ultimately to a police department as earlier described. However, instead of a dedicated ID chip, UID 215 may alternatively be information stored in a dedicated portion of memory 408, where such user identification information is stored at the time of purchase of the slam cam. In that case, the information is provided from memory 408 via bus 404 and bus 402 to modem 203 for broadcast via antenna 205 for eventual utilization by a police department as earlier described.

Strobe light 208 and audio warning 212 are energized over bus 400 by operation of button 209 and shall continue to blinding-flash and audio-blast until shut off. Button 209 may be designed with a mechanical catch (not shown) that prevents, or makes very difficult, disengagement of the button switch by the assailant or anyone other than the slam cam operator who knows how to turn off the device, thereby allowing the device to continue to operate and transmit even if control of the device is lost. In addition to the victim knowing how to disengage button switch 209, it may be programmed to be shut off by computer control 206 via bus 404 and bus 402 after a specified period of time, or it may be shut off remotely by signals received by antenna 205 from police department 106A or from monitor 105.

Figure 5:
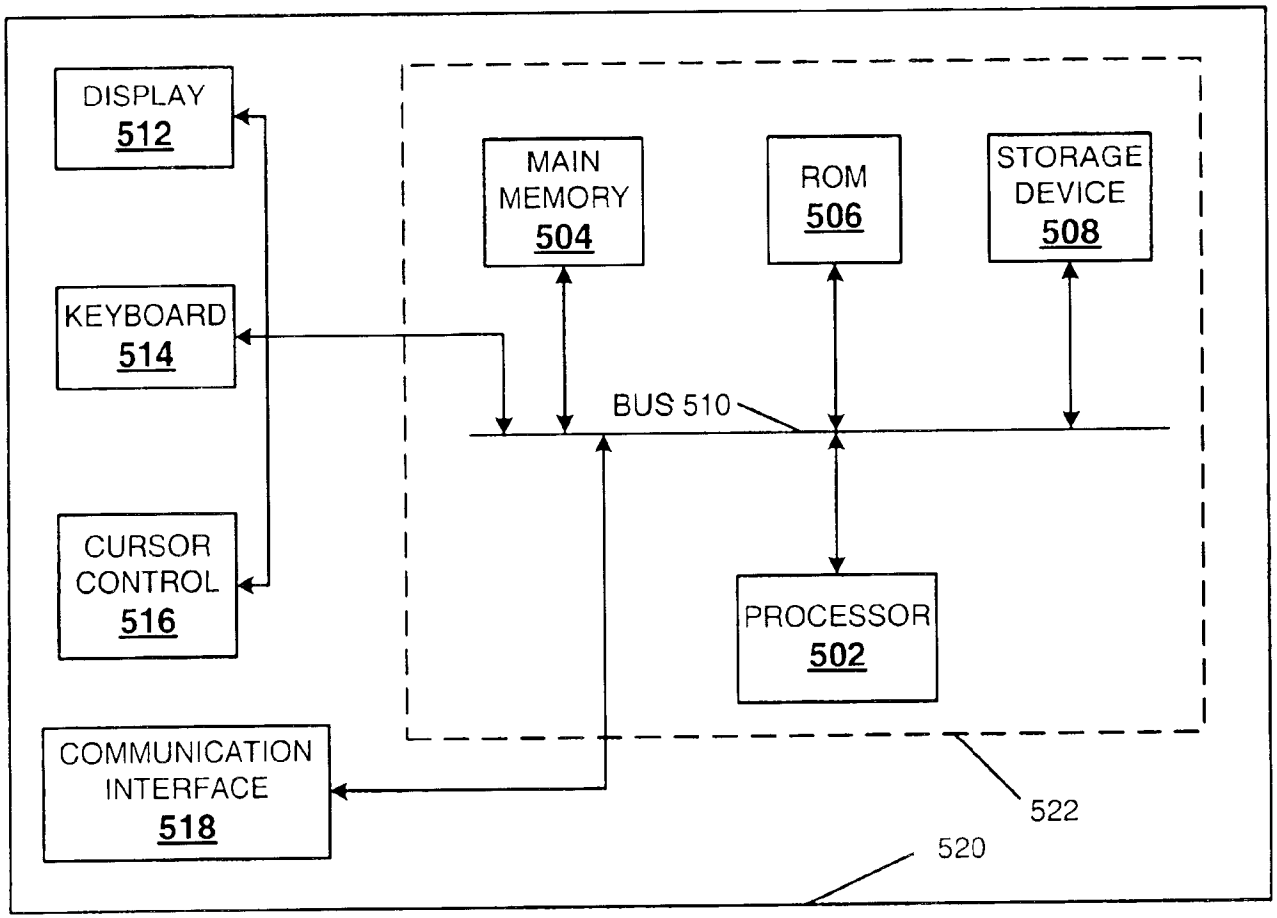

FIG. 5—Block Diagram—Receiver, Processor, Monitor, Police Dept.

FIG. 5 is an exemplary block diagram of computer system 520 which represents functionality that can be used in whole or in part within receiver/processor 103, monitor 105 and police department 106A of FIG. 1. Computer system 520 is shown comprising computer 522, display 512, keyboard 514, cursor control (mouse) 516, and communication interface 518.

First, consider receiver and processor 103 which comprises communication interface 518 and computer 522 only. Display 512, keyboard 514, and mouse 516 are not needed in receiver and processor 103 because no human interactive monitoring is performed at this stage of the signal communication. Communication interface 518 may comprise an antenna, demodulator, and amplifier (not shown) to receive, demodulate and amplify the signals received from antenna 205 in the slam cam. The signals are multiple and varied as they represent visual information from camera 202, audio information from microphone 213, positioning information from GPS 204, as well as user information from UID 215. Depending upon the type of transmission for each of these signals, multiple demodulators in communication interface 518 may be needed. Computer 522 includes processor 502 and memory such as main memory 504, ROM 506 and auxiliary storage device 508 (cache, RAM, etc.). The processing of signals received by communication interface 518 is accomplished in computer 522. The information processed from these signals comprises database 104 which can be housed on main memory 504 located at the site of receiver and processor 103 or can be located elsewhere.

Next, consider monitor 105 which may comprise all of the components of FIG. 5. The database information is of no particular value unless it is being monitored on a continuous basis because an unwanted attack can happen at any time of day or night on any day of the week. Thus, in monitor 105 (which may comprise multiple terminal screen monitors), human operators continuously observe display 512, utilizing keyboard 514 and cursor control 516 to read the information inputs received via communication interface 518 (where bus 111 may be any suitable communication link such as the Internet, and intranet or local area network, or other hard wire or telecommunication connection). The human operators then verify the information as being bona fide and not a false alarm and send the appropriate information over network connection 112A to police department 106A. Connection 112A can likewise be any suitable network connection such as the Internet, an intranet or local area network (LAN) or other hard wire or telecommunication connection. Connection 112 can be any standard police-to-police communication infrastructure.

Finally, consider the mechanism in police department 106A for observing the informational inputs received. It likewise may need a full complement of capability including all of the components shown in FIG. 5. Police personnel observe the emergency call placed on its terminal screen 512 and thereby receive the user ID information, the location of the crime information, a video and/or still picture of the assailant on its terminal screen in real time, and a sound presentation of what is happening at the scene of the attack. Police personnel from police department 106A (or 106 as may be the case) immediately dispatch a patrol car nearest that location to provide police services as needed.

While several illustrative embodiments of the present invention have been shown and described, numerous variations and alternative embodiments may occur to those skilled in the art. For example, although at least the digital camera and GPS components are significant to operation of the present invention, other features may not be. Accordingly, miniaturization of the device, utilizing fewer than all features disclosed herein and/or based on technological miniaturization advances of any of the components in the slam cam, is included within the spirit and scope of the present invention. Therefore, such a miniaturized slam cam may be worn rather than carried by the user, for example, on the wrist like a wristwatch, or perhaps on a hat (e.g. similar to a flashlight in a miner's hat), or in a jacket lapel, or otherwise associated with such user. These and other variations and alternative embodiments are contemplated, and can be made without departing from the spirit and scope of the present invention as defined in the appended claims.

What is claimed is:

1. A non-lethal, personal, deterrent system providing deterrent protection for a system user against an assailant, said system comprising a portable device including identification information of said user, said device obtaining global positioning system location-data specifying location of said device and said assailant and obtaining an image of said assailant;

a transmitter integrated with said portable device for transmitting said identification information, said location-data and said image to a dedicated receiving and processing center;

means for immediately relaying said identification information, said location-data and said image to a police department nearest to said location, whereby personnel of said department can immediately respond; and said device including a switch activatable by said user to operate said system, said switch being configured to:

prevent or make difficult de-activation of said switch by said assailant, thereby allowing said device to continue to operate should assailant gain control of said device; and, be de-activated remotely by said police department.

2. The system of claim 1 further comprising:

a warning mechanism integrated with said device for flashing a bright strobe light on said assailant as a deterrent and to facilitate the obtaining of said image.

3. The system of claim 2 wherein:

said portable device comprises a digital camera for obtaining said image, and, said transmitter comprises an antenna and a wireless modem for modulating and demodulating said identification information and digital information corresponding to said image in preparation for broadcast from said antenna to said dedicated receiving and processing center.

4. The system of claim 1 wherein said portable device includes a digital camera for obtaining said digital image.

5. The system of claim 4 wherein said relaying means further comprises:

a monitor which can determine if said transmission represents a genuine attack or a false alarm;

if said genuine attack, said monitor including means for immediately relaying said identification information, said location-data, and said image to said police department to, enable said personnel to view said assailant at said location to facilitate appropriate response of said personnel.

6. The system of claim 1 wherein said device is battery powered by rechargeable batteries.

7. The system of claim 6 wherein said device is designed to resemble shape of a videocam or flashlight, a compartment for said batteries located inside the handgrip of said device.

8. The system of claim 1 wherein said image is a digital video image.

9. The system of claim 8, wherein said digital video image is a digital video facial image.

10. The system of claim 1 wherein said identification information relaying means includes monitor means for forwarding a bill representing broadcast time charges to a pre-arranged billing address of said user.

11. A method for providing a user/victim with non-lethal, personal, protection from an attack by an assailant comprising:

obtaining and having available identification information of said user/victim;

obtaining global positioning system location-data specifying location of said attack;

obtaining a video image of said assailant;

establishing a dedicated receiving and processing center;

transmitting said identification information, said location-data, and said image to said receiving and processing center;

verifying the validity of said identification information, said location-data, and said image to obtain validated information;

forwarding said validated information to a police department for response and preventing said assailant from readily stopping while allowing said police department to remotely stop, said information obtaining said location-data obtaining, said video-image obtaining, said establishing, and said transmitting.

12. The method of claim 11 further comprising:

flashing a bright strobe light on said assailant as a deterrent and to facilitate the obtaining of said image.

13. The method of claim 11 wherein said image is a digital video image.

14. The method of claim 13 wherein said digital video image is a facial image.

15. A device associated with a user of said device for providing deterrent protection against an assailant of said user by obtaining police intervention comprising:

a digital camera for taking a picture of said assailant;

an antenna;

a modem for modulating signals from said camera for broadcast over said antenna to said police;

a global positioning system for determining location of said device and for broadcasting said location over said antenna for use by said police; and said device including a switch activatable by said user to operate said system, said switch being configured to;

prevent or make difficult de-activation of said switch by said assailant thereby allowing said device to continue to operate should assailant gain control of said device; and, be de-activated remotely by said police department.

16. The device of claim 15 further comprising:

identification information of said user; and, means for transmitting said identification information of said user for use by said police.

17. The device of claim 16 further comprising:

a strobe light; and, means for flashing said strobe light upon said assailant in synchrony with operation of said digital camera.

18. The device of claim 15 further comprising:

rechargeable batteries for energizing said computer control component and said other components of said device.

19. The device of claim 15, wherein the casing of said device is constructed from hardened plastic and capable of being handheld.

20. The device of claim 19 wherein said casing is brightly colored.

21. The device of claim 20 wherein said brightly colored casing is blaze-orange color.

* * * * *